US006276855B1

(12) United States Patent
Hsien

(10) Patent No.: US 6,276,855 B1
(45) Date of Patent: Aug. 21, 2001

(54) RETRACTILE PEN

(76) Inventor: Ming-Jen Hsien, No. 21, Section 3, Mu Hsin Road, Wen Shan District, Taipei (TW)

( * ) Notice: Subject to any disclaimer, the term of this patent is extended or adjusted under 35 U.S.C. 154(b) by 0 days.

(21) Appl. No.: 09/702,656

(22) Filed: Nov. 1, 2000

(51) Int. Cl.[7] ..... B43K 24/08

(52) U.S. Cl. ..... 401/114; 401/109; 401/112; 401/113; 401/117

(58) Field of Search ..... 401/109, 112, 401/113, 114, 117, 170, 180

(56) References Cited

U.S. PATENT DOCUMENTS 1,355,026 * 10/1920 Austin ..... 401/117
1,701,771 * 2/1929 Stefano ..... 401/109 X
4,601,599 * 7/1986 Katoh ..... 401/109 X
5,423,843 * 6/1995 Werner ..... 401/113 X

* cited by examiner

*Primary Examiner*—Gregory L. Huson
*Assistant Examiner*—Kathleen J. Prunner
(74) *Attorney, Agent, or Firm*—Dougherty & Troxell

(57) ABSTRACT

A retractile pen includes an outer barrel and an inner barrel axially slidably received in the outer barrel. The outer barrel is provided with two axially spaced and aligned stop holes and the inner barrel is provided with an elastically depressible button adapted to partially project from either of the stop holes. By engaging the button on the inner barrel with a different stop hole on the outer barrel, the pen can be adjusted to either a longer length to facilitate writing with the pen or a shorter length to facilitate convenient carrying of the pen.

1 Claim, 6 Drawing Sheets

RETRACTILE PEN

BACKGROUND OF THE INVENTION

The present invention relates to a retractile pen, and more particularly to a pen including an outer barrel and an inner barrel axially slidably received in the outer barrel, so that the pen could be adjusted to any one of two different lengths as necessary.

There are various types of pens available in the markets. These pens can be generally divided into two categories, namely, office and non-office pens. Office pens usually have regular configurations and are designed mainly for smooth writing in offices and other similar places. The non-office pens usually have novel shapes and are designed mainly for use as giveaways. Either office or non-office pens, they usually have fixed lengths that might be too short to be comfortably held for writing or too long to be conveniently held in, for example, a pocket. It is therefore desirable to have a pen with a length-adjustable barrel, so that the pen may be used either as an office or a non-office pen.

SUMMARY OF THE INVENTION

A primary object of the present invention is to provide a retractile pen that includes an outer barrel and an inner barrel axially slidably received in the outer barrel. The outer barrel is provided with two axially spaced and aligned stop holes and the inner barrel is provided with an elastically depressible button adapted to partially project from the stop hole. By engaging the button on the inner barrel with different stop holes on the outer barrel so that the inner barrel is fixed in place with different amounts of the inner barrel extended from the outer barrel, the pen can be adjusted to either a longer length to facilitate writing with the pen or a shorter length to facilitate convenient carrying of the pen.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
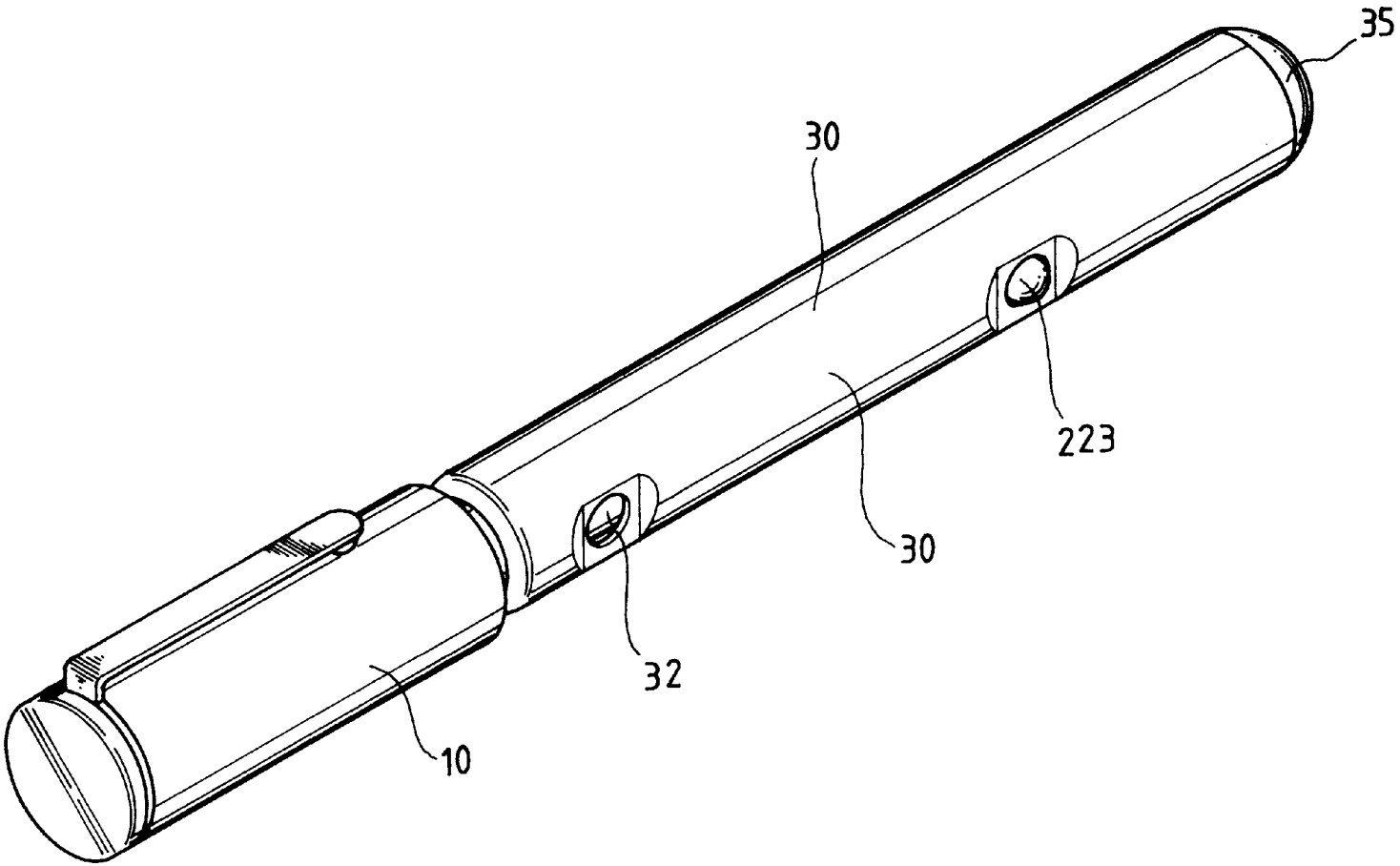
FIG. 1 is a perspective of a retractile pen of the present invention in a retracted state.
Figure 2:
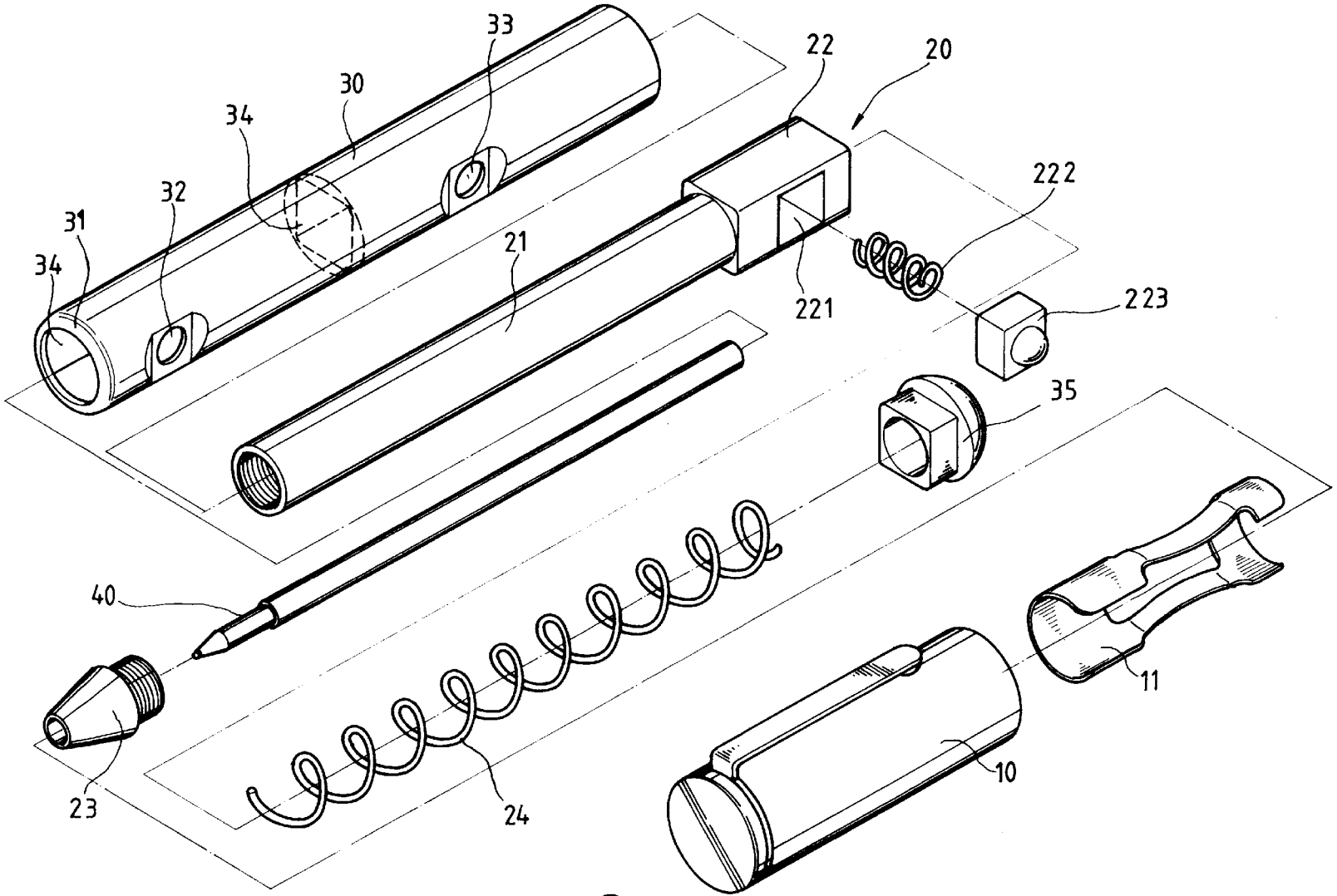
FIG. 2 is an exploded perspective of the retractile pen of the present invention.
Figure 3:
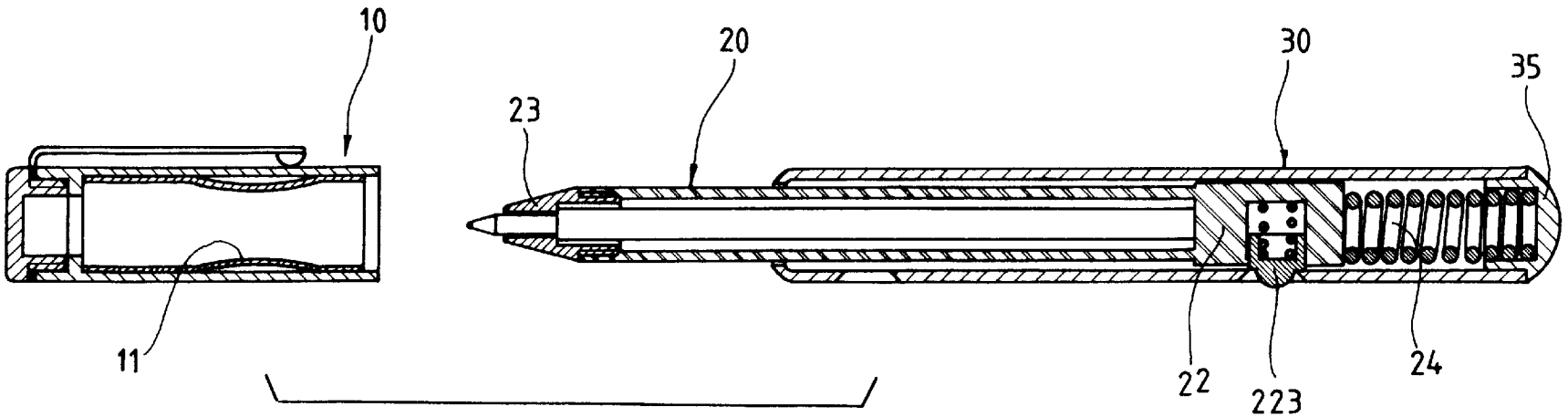
FIG. 3 is a sectioned side view of the retractile pen of the present invention in a retracted state with a cap thereof detached from the pen.
Figure 4:
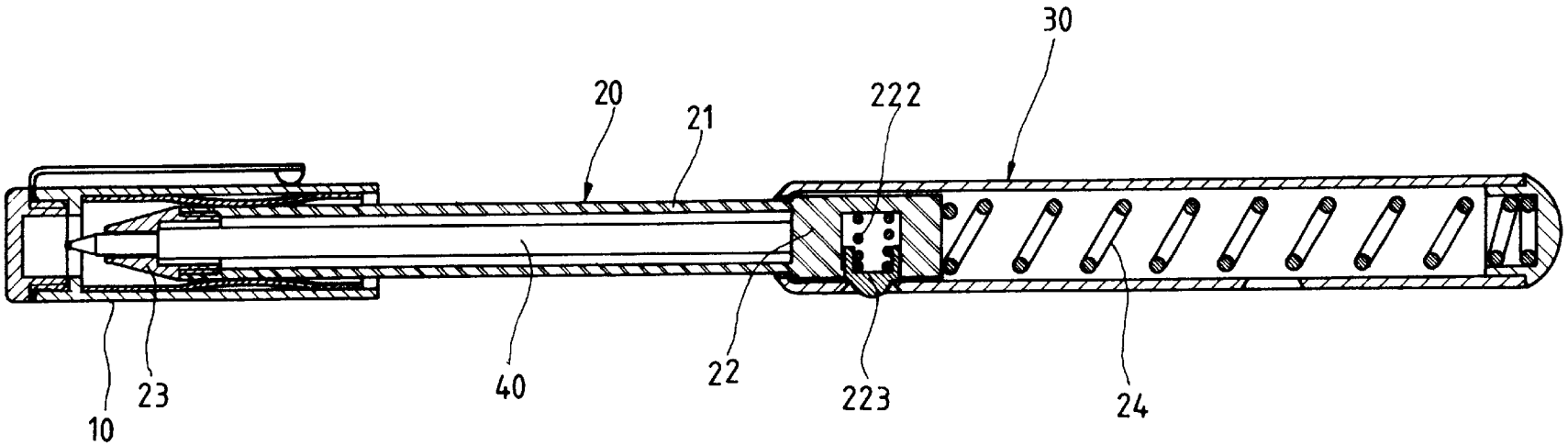
FIG. 4 is a sectioned side view of the retractile pen of the present invention in an extended state.

Please refer to FIGS. 1 through 4 in which a retractile pen according to an embodiment of the present invention is shown. The retractile pen mainly includes a cap 10, an inner barrel 20, an outer barrel 30, and an ink cartridge 40. The inner barrel 20 is axially slidably received in the outer barrel 30 to, together with the outer barrel 30, form a body of the retractile pen of the present invention.

The outer barrel 30 has a diametrically reduced front open end 31 that allows the inner barrel 20 to smoothly slide forward and outward in and relative to the outer barrel 30 without separating from the outer barrel 30. A sectioned outer profile of the outer barrel 30 may be of any shape while a sectioned inner profile of the outer barrel 30 preferably includes at least two diametrically opposite plane surfaces 34. The outer barrel 30 is provided at one side corresponding to one of the plane surfaces 34 with two axially spaced but aligned through holes, namely, a front stop hole 32 and a rear stop hole 33.

The inner barrel 20 includes a longer round tube portion 21 and a shorter square block portion 22 extended from a rear end of the round tube portion 21. The square block portion 22 serves as a guide block that has dimensions corresponding to that of the sectioned inner profile of the outer barrel 30, particularly to the plane surfaces 34, and is therefore suitable for guiding the inner barrel 20 to axially stably slide in the outer barrel 30. When the inner barrel 20 is moved forward to a most front position in the outer barrel 30, the guide block portion 22 abuts against and is stopped by the diametrically reduced front open end 31 of the outer barrel 30 from moving any further, preventing the inner barrel 20 from completely separating from the outer barrel 30.

The guide block portion 22 of the inner barrel 20 is provided at one side corresponding to the plane surface 34 having the stop holes 32, 33 with a recess 221. The recess 221 has a predetermined depth such that a first spring 222 and a button 223 in front of the spring 222 are inward depressibly received in the recess 221. When the recess 221 is aligned with any one of the stop holes 32 or 33, the button 223 is pushed forward by the first spring 222 to project a front portion from the stop hole 32 or 33 and thereby holds the inner barrel 20 in place in the outer barrel 30. A second spring 24 is disposed in the outer barrel 30 behind a rear end of the inner barrel 20, that is, behind the guide block portion 22. And, a head cap 35 is fitted to close a rear end of the outer barrel 30 and seal the second spring 24 between the rear end of the outer barrel 30 and the rear end of the inner barrel 20, so that the second spring 24 normally pushes the inner barrel 20 forward.

A conic cap 23 is adapted to screw onto a front open end of the inner barrel 20. The ink cartridge 40 has a predetermined length and is received in the inner barrel 20 with a writing tip thereof normally projected from the front cap 23 for writing.

The cap 10 has a retaining member 11 mounted therein, so that the conic cap 23 can be detachably held in the cap 10 by the retaining member 11.

Figure 5:
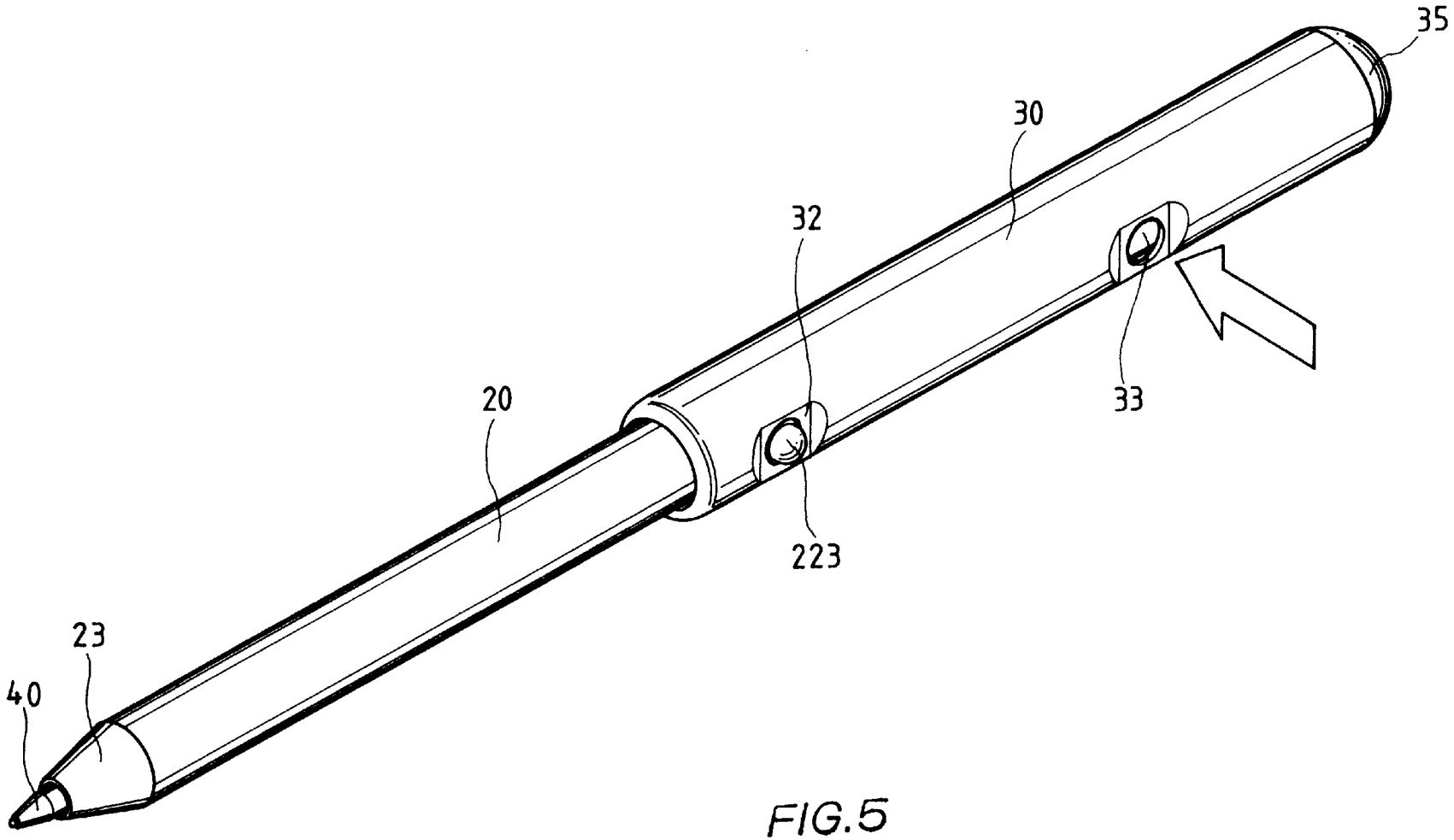
FIG. 5 is a perspective of the retractile pen of the present invention in an extended state with the cap removed from the pen.
Figure 6:
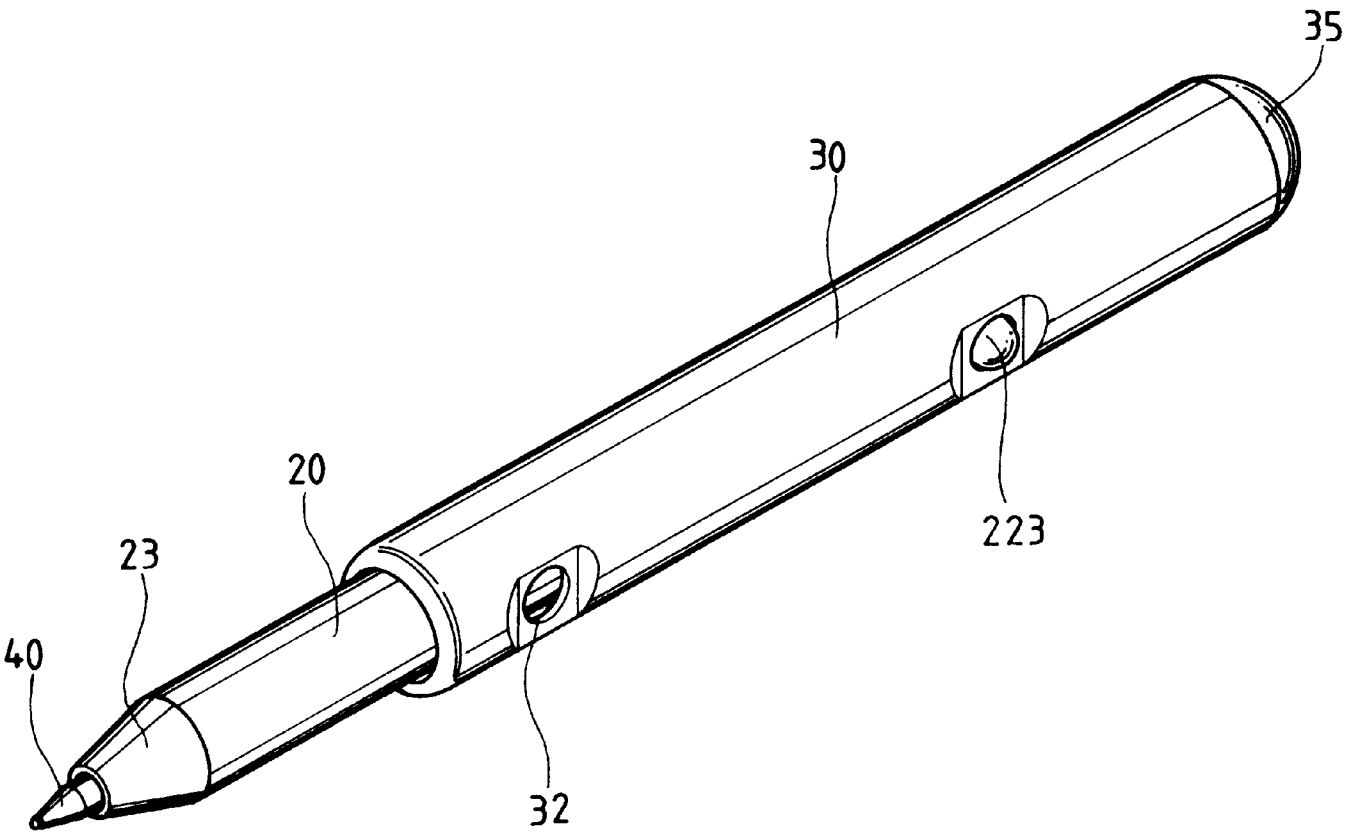
FIG. 6 is a perspective of the retractile pen of the present invention in a retracted state with the cap removed from the pen.

Please now refer to FIGS. 3 through 6. When the button 223 on the inner barrel 20 is caused to engage with and project from the rear stop hole 33 on the outer barrel 30, the inner barrel 20 retracts to be received in the outer barrel 30 and therefore shortens an overall length of the pen for the latter to be conveniently positioned in, for example, a pocket or other small-sized container. And, when the button 223 is depressed to disengage from the rear stop hole 33, the second spring 24 immediately pushes the inner barrel 20 forward until the button 223 meets and projects from the front stop hole 32 on the outer barrel 30. At this point, the round tube portion 21 of the retracted inner barrel 20 completely extends out of the outer barrel 30 with the square guide block portion 22 pressing a front end against the diametrically reduced front open end 31 and being stopped from moving any further. The outward extended inner barrel 20 therefore lengthens the overall length of the pen to facilitate convenient holding of the pen by a user to write.

What is claimed is:

1. A retractile pen comprising an outer barrel and an inner barrel axially slidably received in said outer barrel;

said outer barrel having a diametrically reduced front open end that allows said inner barrel to smoothly slide forward and outward in and relative to said outer barrel without completely separating from said outer barrel; said outer barrel having a sectioned outer profile of any shape and a sectioned inner profile including at least two diametrically opposite plane surfaces; said outer barrel being provided at one side corresponding to one of said plane surfaces with two axially spaced but aligned through holes, namely, a front stop hole and a rear stop hole; and said inner barrel including a longer round tube portion in which an ink cartridge is received and a shorter square guide block portion extended from a rear end of said round tube portion; said guide block portion having dimensions corresponding to that of said sectioned inner profile of said outer barrel, particularly to said plane surfaces, for guiding said inner barrel to axially stably slide in said outer barrel; said guide block portion being provided at one side corresponding to said plane surface of said outer barrel having said stop holes with a recess that has a predetermined depth such that a first spring and a button in front of said first spring are inward depressibly received in said recess, whereby when said recess is aligned with any one of said stop holes, said button is pushed forward by said first spring to project a front portion from said stop hole and thereby hold said inner barrel in place in said outer barrel; and a second spring being disposed in said outer barrel behind a rear end of said guide block portion and a head cap being fitted to close a rear end of said outer barrel and seal said second spring between the rear end of said outer barrel and the rear end of said inner barrel, so that said second spring normally pushes said inner barrel forward; whereby when said inner barrel is forwardly pushed by said second spring with said button aligned with and projected from said front stop hole, said retractile pen has an extended length, and when said inner barrel is forwardly pushed by said second spring with said button aligned with and projected from said rear stop hole, said retractile pen has a shortened length.

* * * * *